US009192873B2

(12) United States Patent
Lewis

(10) Patent No.: US 9,192,873 B2
(45) Date of Patent: Nov. 24, 2015

(54) MESSAGING DIGIT COVER AND METHOD OF MAKING

(71) Applicant: Thomas Lewis, Birmingham, AL (US)

(72) Inventor: Thomas Lewis, Birmingham, AL (US)

(73) Assignee: VICTORY FINGERS, LLC, Birmingham, AL (US)

( * ) Notice: Subject to any disclaimer, the term of this patent is extended or adjusted under 35 U.S.C. 154(b) by 0 days.

(21) Appl. No.: 14/178,249

(22) Filed: Feb. 11, 2014

(65) Prior Publication Data

US 2014/0227931 A1 Aug. 14, 2014

Related U.S. Application Data

(60) Provisional application No. 61/763,435, filed on Feb. 11, 2013.

(51) Int. Cl.

| | |
|---|---|
| ***A63H 33/00*** | (2006.01) |
| ***A63H 37/00*** | (2006.01) |
| ***G09F 21/02*** | (2006.01) |
| *A41D 13/08* | (2006.01) |

(52) U.S. Cl.

CPC ..... *A63H 33/00* (2013.01); *A63H 37/00* (2013.01); *G09F 21/02* (2013.01); *A41D 13/087* (2013.01); *G09F 2021/023* (2013.01)

(58) Field of Classification Search

USPC ..... 446/26, 327, 328; 2/21, 159, 160, 163, 2/167; 434/159

See application file for complete search history.

(56) References Cited

U.S. PATENT DOCUMENTS

| | | | | | |
|---|---|---|---|---|---|
| 4,369,215 | A | * | 1/1983 | Offen et al. | 428/4 |
| 4,519,781 | A | * | 5/1985 | Boyd | 434/156 |
| 6,057,501 | A | * | 5/2000 | Hale | 84/470 R |
| 6,142,785 | A | * | 11/2000 | Williams | 434/205 |
| 6,155,836 | A | * | 12/2000 | Hancock | 434/188 |
| 6,951,464 | B2 | * | 10/2005 | Cubeta et al. | 434/159 |
| 7,296,999 | B2 | * | 11/2007 | Webber | 434/168 |
| 7,690,322 | B2 | * | 4/2010 | Lanh | 116/173 |
| D682,507 | S | * | 5/2013 | Hatfield et al. | D2/623 |
| D682,508 | S | * | 5/2013 | Hatfield et al. | D2/623 |
| 8,803,844 | B1 | * | 8/2014 | Green et al. | 345/174 |
| 2006/0212990 | A1 | * | 9/2006 | Mattesky | 2/161.6 |
| 2008/0005822 | A1 | * | 1/2008 | Lavner et al. | 2/21 |
| 2009/0183297 | A1 | * | 7/2009 | Drosihn | 2/167 |
| 2011/0016609 | A1 | * | 1/2011 | Phelps et al. | 2/162 |
| 2011/0047672 | A1 | * | 3/2011 | Hatfield | 2/163 |
| 2011/0265245 | A1 | * | 11/2011 | Asiaghi | 2/167 |
| 2011/0289654 | A1 | * | 12/2011 | Williams et al. | 2/167 |
| 2012/0096621 | A1 | * | 4/2012 | Baacke | 2/69 |
| 2013/0021292 | A1 | * | 1/2013 | Tatelbaum et al. | 345/174 |
| 2013/0191961 | A1 | * | 8/2013 | Litke | 2/161.2 |
| 2013/0291280 | A1 | * | 11/2013 | Cheng | 2/160 |

* cited by examiner

*Primary Examiner* — Kurt Fernstrom

(74) *Attorney, Agent, or Firm* — Bergman & Song LLP; Michael A. Weinstein; Michael Bergman

(57) ABSTRACT

A digit cover for conveying a non-verbal message. The digit cover includes at least a first message area for conveying a first message. The digit cover may also include additional message areas for conveying additional messages.

20 Claims, 18 Drawing Sheets

805

855

MESSAGING DIGIT COVER AND METHOD OF MAKING

CROSS REFERENCE TO RELATED APPLICATION

This application claims the benefit of U.S. provisional patent application No. 61/763,435, filed Feb. 11, 2013, the disclosure of which is incorporated herein by reference in its entirety.

BACKGROUND OF THE INVENTION

Communication is an integral part of societies. Individuals often and/or frequently wish to communicate a message to others. The message may be, for example, a message, e.g., a message of support for an individual, company, service, or belief. In many environments, an individual may be limited in the manner in which she can convey the message. For example, in certain environments the individual cannot effectively convey a message orally, because of the context, e.g., a stadium. Many environments also limit the use of printed messages. For example, printing a message on a poster board is cumbersome and bulky and when raised by an individual in a seat, it can impair the enjoyment of others, e.g., by at least blocking other view or getting bumped. Therefore, it would be desirable to have a method of conveying a message that would not significantly impair other's enjoyment.

DETAILED DESCRIPTION OF THE INVENTION

In the following detailed description, reference is made to the accompanying drawings, which form a part hereof, and in which is shown by way of illustration specific exemplary embodiments of the invention. These embodiments are described in sufficient detail to enable those of ordinary skill in the art to make and use the invention, and it is to be understood that structural, logical, or other changes may be made to the specific embodiments disclosed without departing from the spirit and scope of the present invention.

The invention discloses a method for communicating a message by way of a cover worn over a human digit, preferably a finger.

Figure 1:
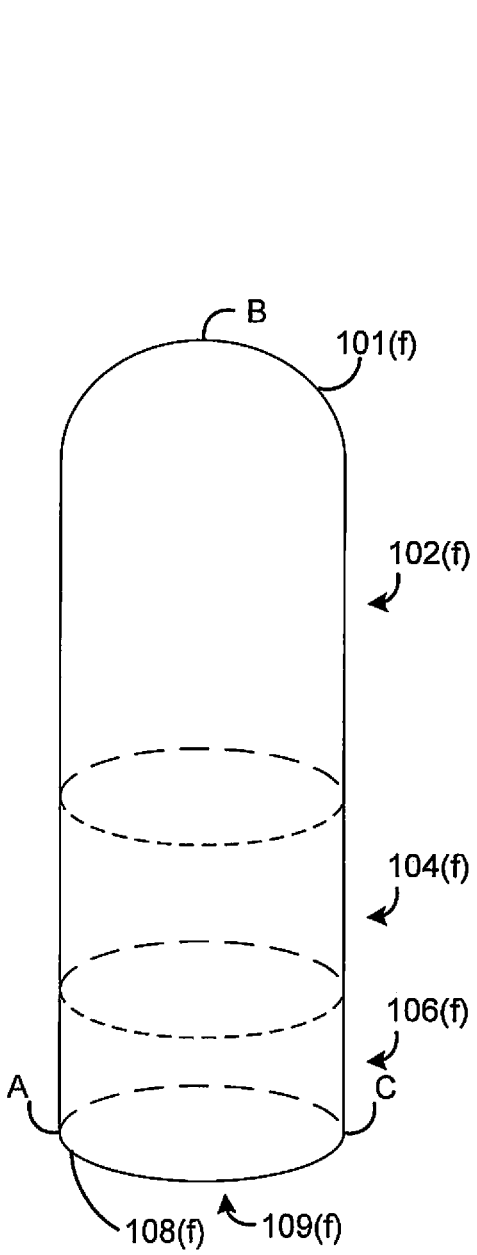
FIG. 1 depicts a digit cover in accordance with an exemplary embodiment of the invention.

FIG. 1 discloses a front side 101(*f*) of a digit cover 100 according to an exemplary embodiment of the invention. The first side 101(*f*) has a first message area 102(*f*). The first side 101(*f*) may also include a second message area 104(*f*) and third message area 106(*f*). The perimeter edge 108(*f*) of first side 101(*f*) is along the edge of the first side 101(*f*) from point A to point B to point C. The bottom edge 109(*f*) of first side 101(*f*) is along the edge of the first side 101(*f*) from point A to point C.

A message is displayed in a message area. A message is a word, phrase, symbol, graphic, picture, and analogous message types, and any combination of message types. The message is displayed in any reasonable form and may include several different forms. A message form is, for example, printed, embroidered, included into the manufacture of the fabric, electrically displayed, electrically lighted or any other reasonable form and/or combination of forms. In an approach, Dye sublimation is used to form the message.

A digit cover may have a single area for displaying a message area or a plurality of areas. For a digit cover with a plurality of message areas, a first message in a first message area may be the same, e.g., whereby the first message is substantially related or corresponds to the second message, or different, e.g., whereby the first message is substantially unrelated to the second message, from a second message in a second message area. For example of a different message, a first message is the phrase "Gators" and a second message is the phrase "Tropicana." "Gators" is an expression that pertains to the University of Florida, e.g., "Gator nation." "Tropicana" relates to a brand of Citrus drinks, mostly referring to Orange Juice. Arguably the two terms are unrelated, although they might be related, for example, if Tropicana is a financial supporter of the University of Florida. See, for example, FIG. 8B.

For a digit cover with a plurality of message areas, a message in a first message area may relate to a message in a second message area. For example of a related message, a first message is the phrase "A" and a second message is an image of the phrase "Roll Tide!". In this example, arguably, the two phrases are related. "A" is a symbol used to represent the University of Alabama. "Roll Tide" is how some people refer to the University of Alabama. Thus, the two phrases are likely related.

In an exemplary approach, a digit cover is designed to cover at least a significant portion of a finger. Preferably, a digit cover is sized to fit a majority of the adult population's fingers. A digit cover is tapered in shape such that it has a smaller circumference at the portion of the digit cover intended for the top, or end, of a finger and a little larger circumference at the portion of the digit cover intended for the bottom, or end, of a finger. In another aspect, digit covers are available in four different sizes: large, medium, small, and kids.

In an exemplary approach, an elastic, stretchable, flexible fabric is employed to make the digit cover. For example, a fabric is employed that is no less than 80% polyester and no more than 20% spandex. The selection of the fabric will generally affect the size and shape material used to form of the digit cover and thus should be considered for the size and shape when material is chosen for the digit cover.

In an exemplary approach, a digit cover is formed from two portions, e.g., a front and back side, respectively, of a same or different fabric. In an exemplary approach a first portion is similar to, but reflective, in shape and design as to a second portion. The digit cover is formed by overlapping the first portion with the second portion so that they are substantially aligned. Then the edge of first portion is fastened to the edge of the second portion, leaving a bottom edge open for a digit to be inserted. In an exemplary approach, cut and sown, a sonic weld, or a rotary weld, is employed to fasten the edges, but any suitable fastening method is appropriate. Although the description refers to a fabric cover being constructed from two portions of material, the invention is not so limited and can be constructed from any number of portion(s) of material.

Figure 2:
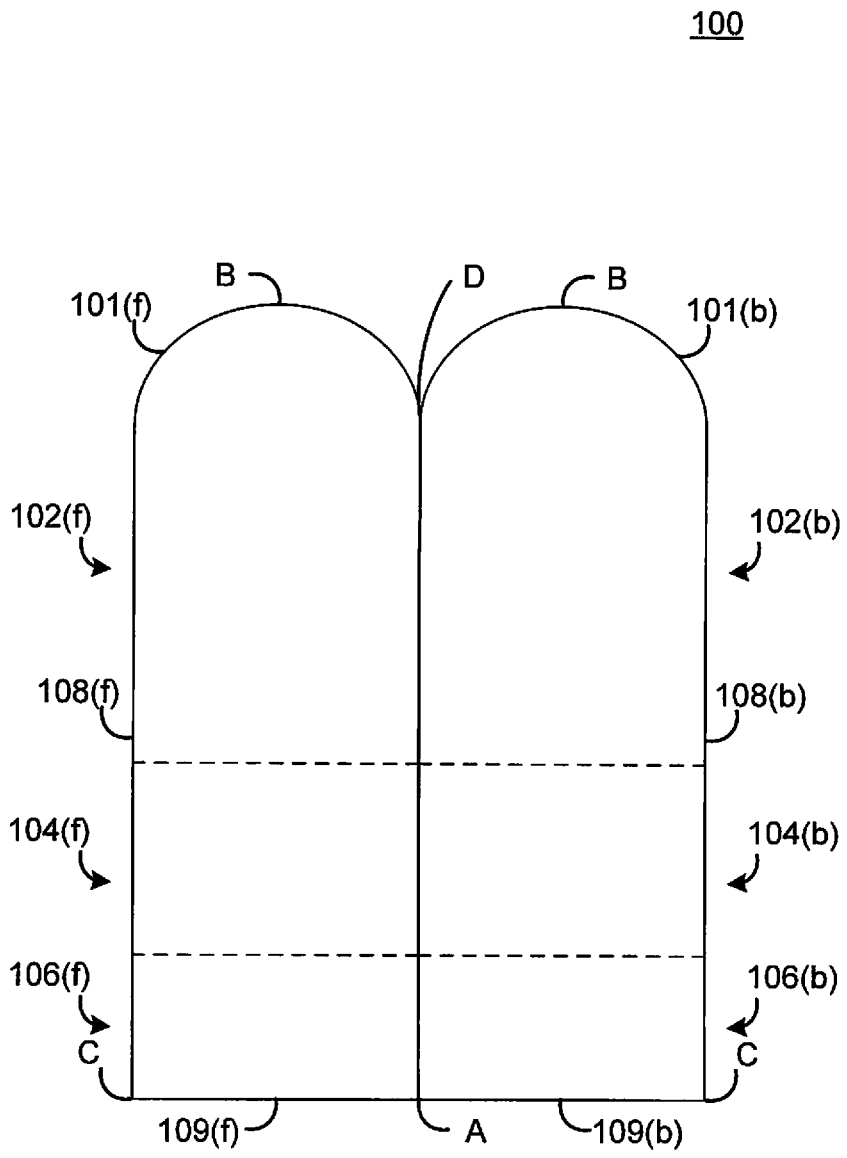
FIG. 2 depicts a digit cover of FIG. 1 in greater detail.

FIG. 2 discloses a plan view of a first side 101(*f*), e.g., a front side, and a second separate side, second side 101(*b*), e.g., a back side, of a digit cover. The first side 101(*f*) has a first message area 102(*f*). The first side 101(*f*) may also include a second message area 104(*f*) and third message area 106(*f*). The perimeter edge 108(*f*) of first side 101(*f*) is along the edge of the first side 101(*f*) from point A to point B to point C. The bottom edge 109(*f*) of first side 101(*f*) is along the edge of the first side 101(*f*) from point A to point C. In FIG. 2, first side 101(*f*) abuts, but is separate from, second side 101(*b*).

The second side 101(*b*) has a first message area 102(*b*). The second side 101(*b*) may also include a second message area 104(*b*) and third message area 106(*b*). The perimeter edge 108(*b*) of second side 101(*b*) is along the edge of the second side 101(*b*) from point A to point B to point C. The bottom edge 109(*b*) of second side 101(*b*) is along the edge of the second side 101(*b*) from point A to point C. The first side and second side are dimensioned to fit over an adult/child human finger in a particular size, depending on the intended size (as discussed above).

To form the digit cover 100, first side 101(*f*) is laid over second side 101(*b*) such that their respective perimeter edges 108(*f*), 108(*b*) are aligned. The message areas are positioned such that they will be on the outside, e.g., exterior side, of the resulting digit cover 100. The first side 101(*f*) is fastened to second side 101(*b*) substantially along perimeter edges 108(*f*), 108(*b*). After fastening, the digit cover 100 will have an opening along bottom edges 109(*f*), 109(*b*), which is where a digit (e.g., a finger) can be inserted at a later time. In an approach, the sides are fastened to each other while the two exterior surfaces touch each other, e.g., the cover is inside-out. After fastening, the cover is turned, resulting in the cover being inside-in and having any remaining edges that result from fastening of the two sides being on the inside of the fabric cover.

In another exemplary approach, first side 101(*f*) and second side 101(*b*) formed from a same fabric and therefore first side 101(*f*) and second side 101(*b*) are not completely separate and share a common edge formed along point A to point D.

Figure 3:
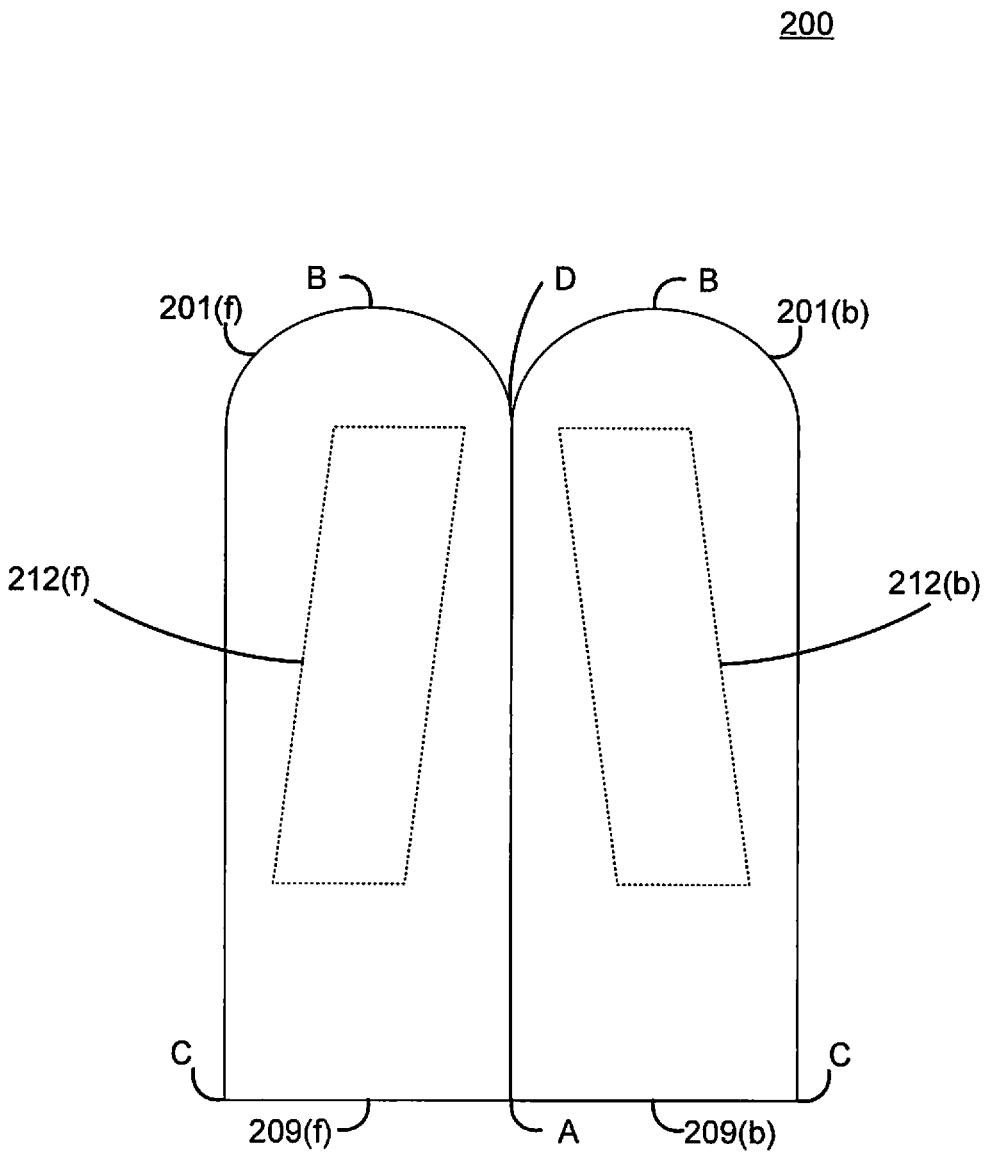
FIG. 3 depicts a digit covers in accordance with another exemplary embodiment of the invention.

FIG. 3 depicts digit cover 200 in another exemplary approach. The digit cover 200 is similar to digit cover 100; however it includes message area 212(*f*) and 212(*b*). Each message area 212(*f*) and 212(*b*) is substantially a slanted vertical text box with a different angle on each of area 212(*f*) and 212(*b*). The top portion of message area 212(*f*) and 212(*b*) is closer to the line formed from Point A to Point D and the bottom portion of message area 212(*f*) and 212(*b*) is farther from the line formed from Point A to Point D. Message area 212(*f*) is substantially reflective to message area 212(*b*). Having a message in a slanted vertical box would increase the likelihood that when the digit cover 200 has been formed and placed on a digit, the message would be a substantially straight, vertical message. Otherwise if a message is employed in a substantially straight message box area, then due to the natural curve to a human digit, the resulting message in a finished cover would not appear straight. The slanted box depicted in FIG. 3 is representational of guidelines of where text and/or graphics will appear or be placed; the box itself is not shown. The imaginary slanted box is used by designers during the design phase for placement of text and/or graphics within or substantially within or as simply a guide for the placement of a message(s). Although referred to as a box, the invention is not so limited and the messaging area can be any shape.

In an exemplary approach, the fabric employed in a digit cover has a flexible fit, i.e., it can be used on either hand and on any of fingers (unlike a glove, mitten, brace, etc.). It also has a flexible fit in that it can be worn facing any direction with no "front or back." Typically, the messaging is on both sides, where the message, most likely is the same on both side, but it does not have to be.

In an exemplary approach, the fabric employed in a digit cover is machine washable and machine dryable.

Figure 4:
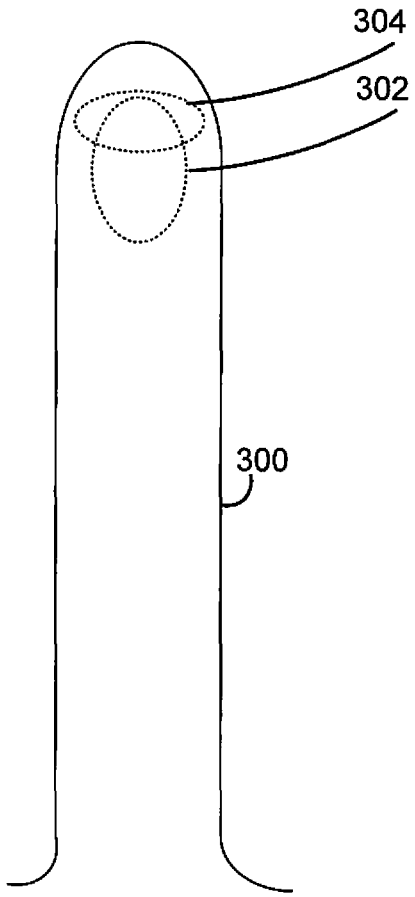
FIG. 4 depicts an exemplary finger.

FIG. 4 depicts the underside, e.g., a palmer or anterior side, of an exemplary digit 300, e.g., an index finger. When using a device having a touch screen, e.g., an iPad, a smart phone, etc, a person will typically touch the screen with either her finger pad 302 or a tip of the finger pad 304.

In another exemplary aspect, the digit cover enables use of touch screen technology without having to remove the digit cover. Although not reflected for simplicity, message areas are included in the digit covers of FIGS. 5 A-D.

Figure 5A:
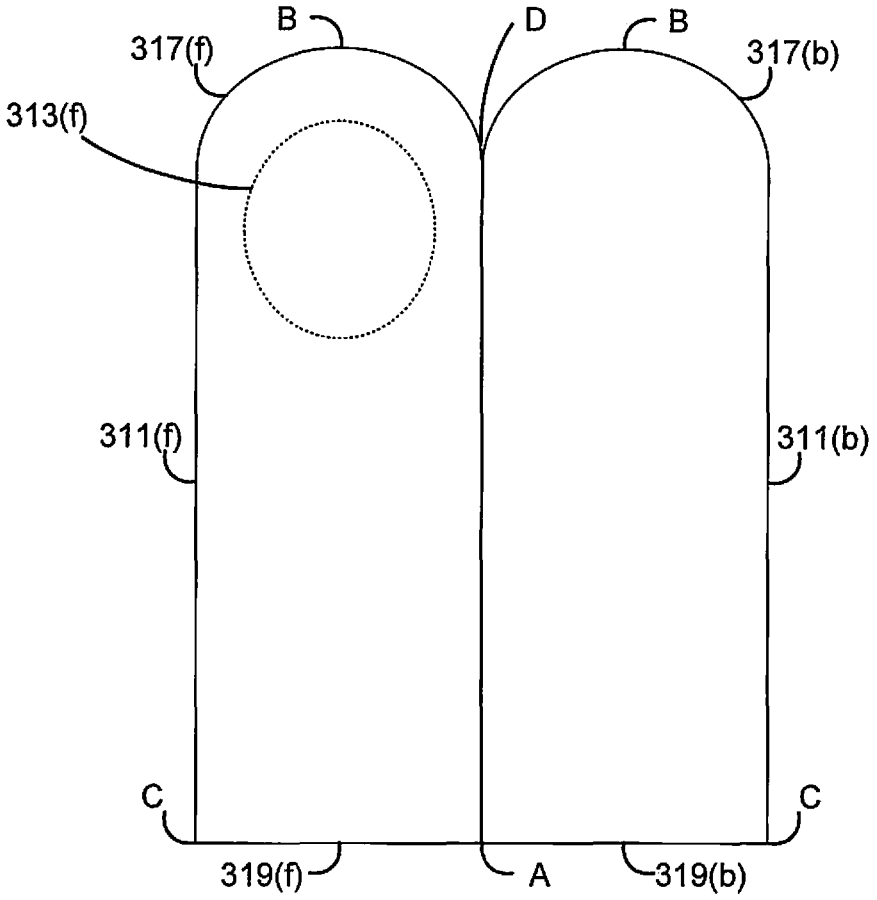
FIGS. 5A-D depict digit covers in accordance with additional exemplary embodiments of the invention.

FIG. 5A discloses a plan view of a first side 311(*f*) and a second side 311 (*b*) of a digit cover 310 according to another exemplary embodiment. The first side 311(*f*) has a touch screen access area 313(*f*). The area 313(*f*) substantially occurs at a location on the digit cover corresponding to where either the finger pad 302 or the tip 304 will coincide with the digit cover 310. In an approach, the area 313(*f*) is substantially oblong shaped, although the invention is not limited to that shape. The area 313(*f*) is designed to allow heat transfer from a digit which increases the effectiveness of using touchscreen technology with the digit cover over a finger. The area 313(*f*) employs fabric that enables thermal transfer. Additionally the area 313(*f*) is designed to be relatively tight to a finger to enable thermal transfer. An exemplary fabric is spandex. This choice of fabric allows heat of a finger to escape onto a technology, e.g., to pass through the digit cover and be received by a Smartphone.

Figure 5B:
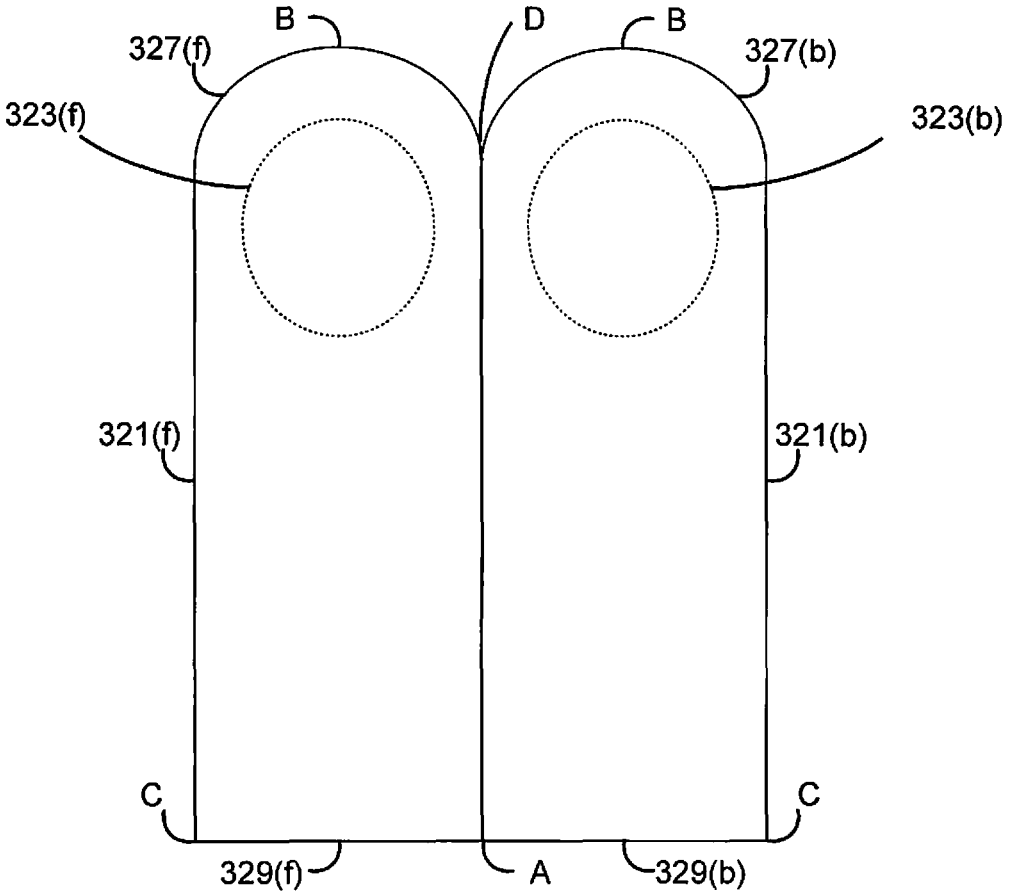

FIG. 5B discloses a plan view of a first side 321(*f*) and a second side 321(*b*) of a digit cover 320 which have a plurality of access areas according to another exemplary embodiment, in this implementation, two access areas. The first side 321(*f*) and second side 321(*b*) each has a respective touch screen access area 323(*f*), 323(*b*). The areas 323(*f*), 323(*b*) substantially occurs at either the finger pad 302 or the tip 304. In this aspect, there are two access areas that can align with a finger pad or a portion of a finger pad.

Figure 5C:
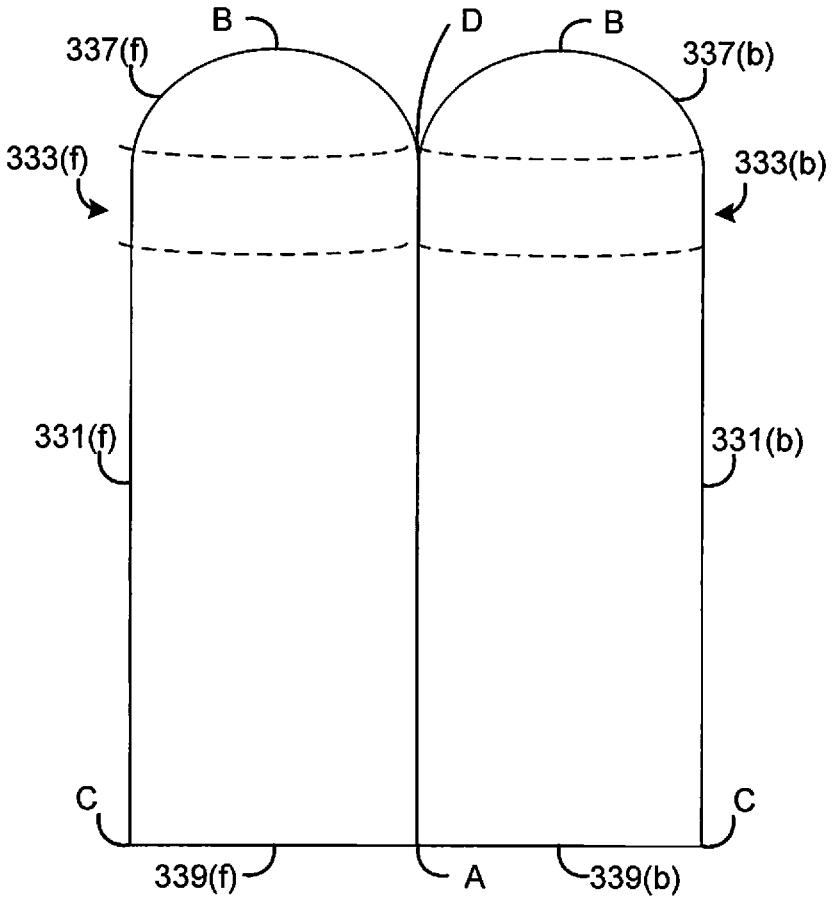

FIG. 5C discloses a plan view of a first side 331(*f*) and a second side 331(*b*) of a digit cover 330 which have according to another exemplary embodiment. The first side 331(*f*) and second side 331(*b*) have a respective touch screen access area 333(*f*), 333(*b*). The areas 333(*f*), 333(*b*) substantially occurs at either the finger pad 302 or the tip 304. In this aspect, there is a continuous access area, e.g., a band of material, that can coincide with a finger pad or a portion of a finger pad within the digit cover. An advantage of using this arrangement of a touch screen access area is that a finger can be at any orientation within the digit cover and still have a finger pad coincide with a touch screen access area.

Figure 5D:
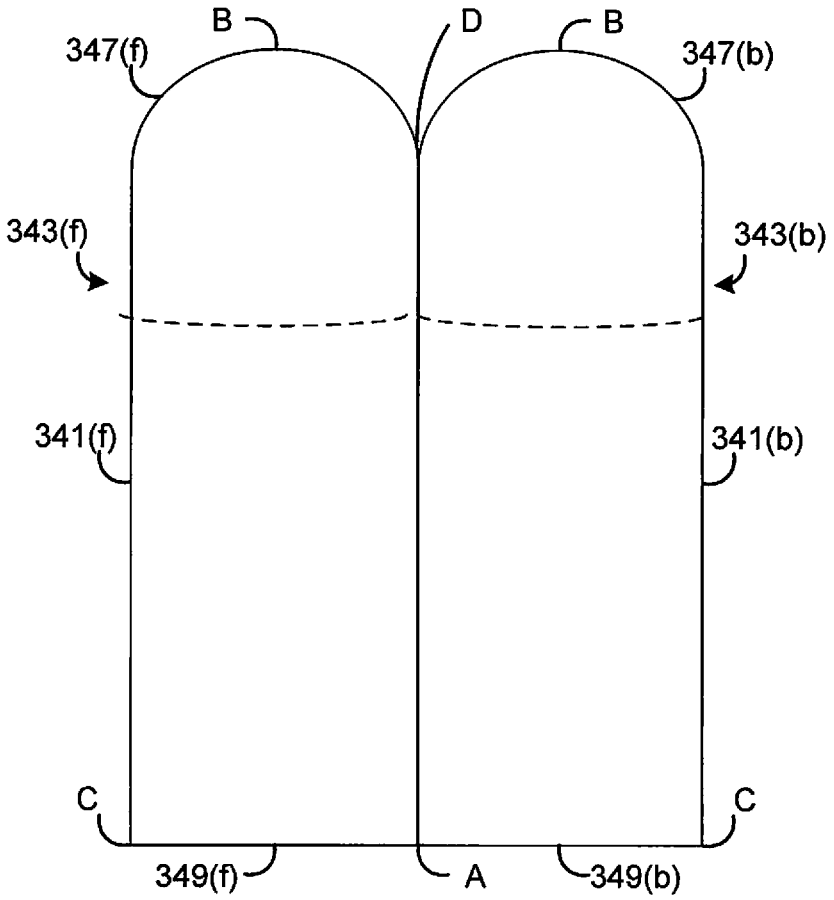

FIG. 5D discloses a plan view of a first side 341(*f*) and a second side 341(*b*) of a digit cover 340 which have according to another exemplary embodiment. The first side 341(*f*) and second side 341(*b*) have a respective touch screen access area 343(*f*), 343(*b*). The areas 343(*f*), 343(*b*) substantially occurs at either the finger pad 302 or the tip 304. In this aspect, there is a continuous access area that can align with a finger pad or a portion of a finger pad. An advantage of using this arrangement of a touch screen access area is that a finger can be at any orientation within the digit cover and still have a finger pad coincide with a touch screen access area.

The fabric used in at least the touch screen access areas of digit covers 310, 320, 330, 340 should be properly-sized to have close contact with the pad or tip of the enclosed finger so as to allow effective heat transfer. Furthermore, the fabric forms to the shape of the finger by using a fastening process, for example, sewing it, in another approach it is a sonic weld process. The fabric is tapered so as to allow enough room for it to fit over the widest part of the finger, the bottom, but allows for the tight fit at the top, where the need for heat transferability is. In another aspect, substantially all of a digit cover is made from the same material.

In another aspect, the invention includes at least two digit covers with webbing in between at least two adjacent fingers. The size of the webbing between digit covers substantially corresponds to the size of area between two spread fingers. A webbing has two sides, at least one side of the webbing has an image comprising text and/or graphics. The image may or may not relate to an image or images on the digit covers that are worn over digits. When the two adjacent covers worn over two respective fingers and the fingers are close to each other, then the webbing is substantially hidden. When the two fingers are spread apart then the webbing is more visible—the more the fingers are spread apart, the more the webbing is made taut, the more easily that the image can be read.

In another aspect, there is a cover topping: a doll, figure, or symbol, fastened on the digit cover, preferably on top or substantially on top of the digit cover. For example, for a digit cover for the University of Florida, there is a three dimensional alligator (the mascot of the University of Florida), of an appropriate material, color, and size that is fastened to the "finger tip." See, for example, FIG. 8C which depicts a University of Alabama Elephant mascot on top of a cover with a University of Alabama "A" in a message area. See also, for example, FIG. 8D which depicts a University of Florida Gator mascot on top of a cover with a University of Florida "Gators" in a message area. There may also be a plurality of dolls, figures and symbols on the top of digit.

Figure 6A:
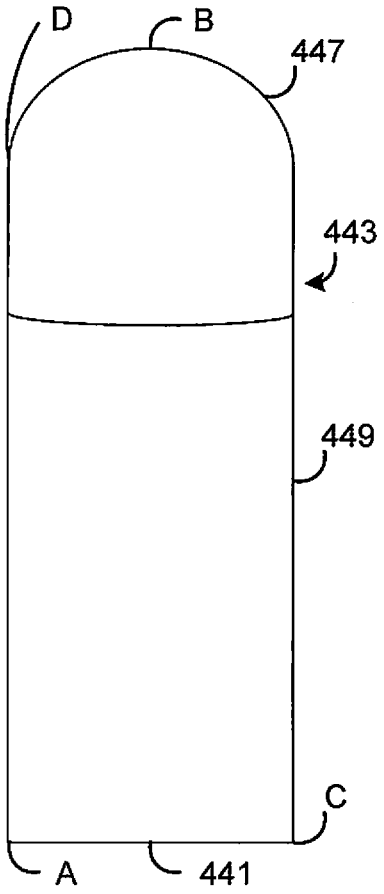
FIGS. 6A-B depict a digit cover in accordance with another exemplary embodiment of the invention.
Figure 6B:
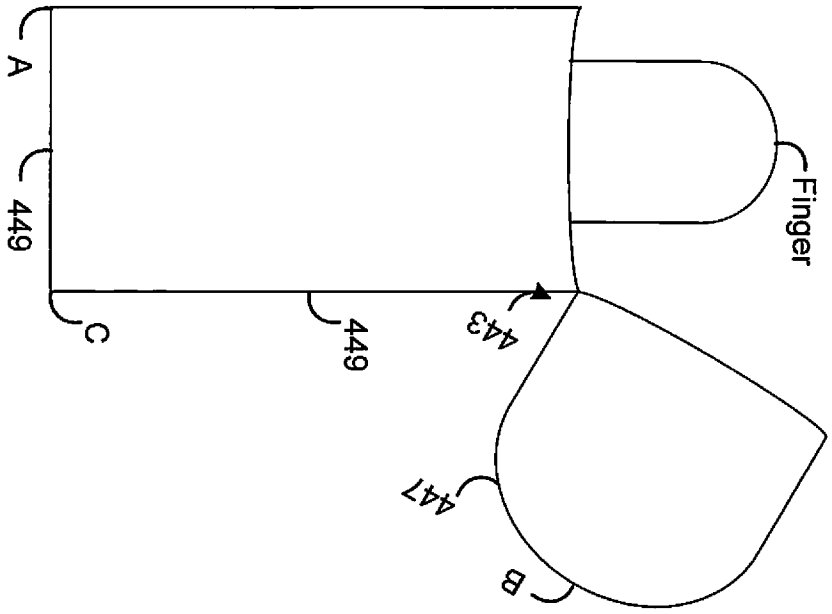

FIGS. 6A and B depict a digit cover 440 in accordance with another exemplary embodiment having a first portion 447 and a second portion 449. A portion of the first portion 447 is fastened to a portion of the second portion 449 forming a "hinge" between the two portions. In a closed fashion, the first portion 447 is "closed" (arguably over a finger within the digit cover 440) and the bottom circumference of first portion 447 is substantially in contact with the top circumference of second portion 449. Thus the top of a digit is covered by first portion 447. In an open fashion, the first portion 447 is "open" and the first portion 447 is substantially only in contact with the second portion 449 by way of the hinge formed between them. Thus the top of a digit is not covered by first portion 447 thereby allowing the end of the finger to be used for certain tasks. Although not reflected for simplicity, message areas are included in the digit cover 440. The message area(s) extend over a portion of a first portion, a second portion or a combination of the first and second portions.

Figure 7:
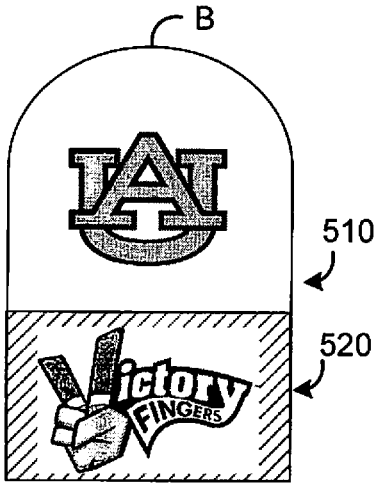
FIG. 7 depicts a digit cover in accordance with another exemplary embodiment of the invention.

FIG. 7 depicts a digit cover 500 in another exemplary aspect. The digit cover 500 has a first, upper portion 510 and a second lower portion 520. The first portion 510 includes a message area (not shown for simplicity) for conveying a message. In a preferred approach, the second portion has a unique trade dress that identifies to third parties the source of the digit cover. For example, VictoryFingers™ is the source for digit covers. Thus, all digit covers 500 would include a trade dress for Victory Fingers™. The trade dress includes, for example, Victory Fingers™' trademark. The trade dress may also include an identifiable background, where the background is, for example, a color, pattern, design, etc.

Figure 8A:
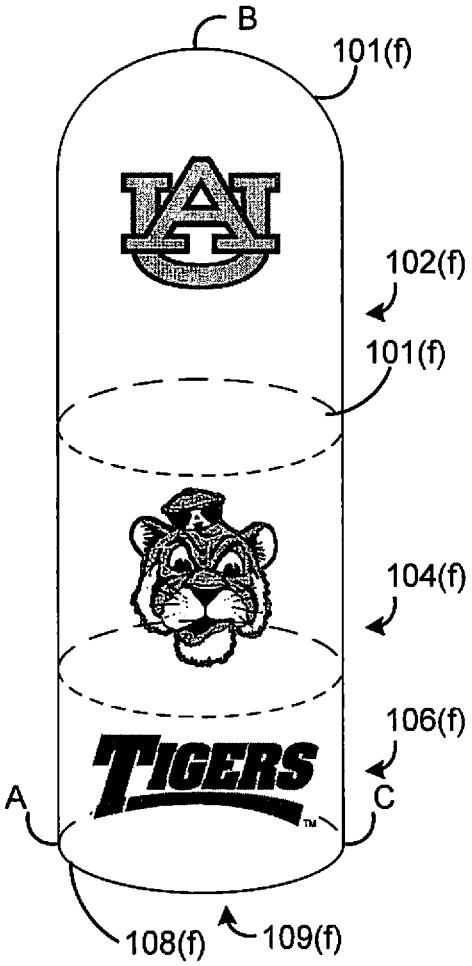
FIGS. 8A-G depict digit covers in accordance with additional exemplary embodiments of the invention.
Figure 8B:
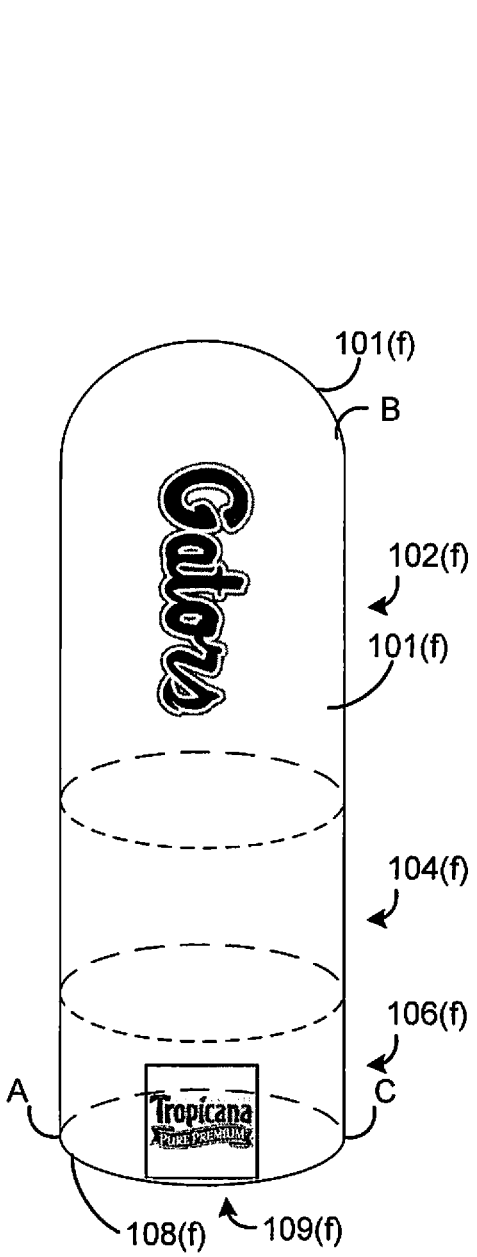

FIGS. 8A-G depict several exemplary approaches to the invention. FIG. 8A depicts a front view of a digit cover having three messages in three message areas. In this example, the three messages are likely related. FIG. 8B depicts a front view of a digit cover having two messages in two message areas. In this example, the messages are not likely related, unless, as discussed above, there is some unapparent relationship.

Figure 8C:
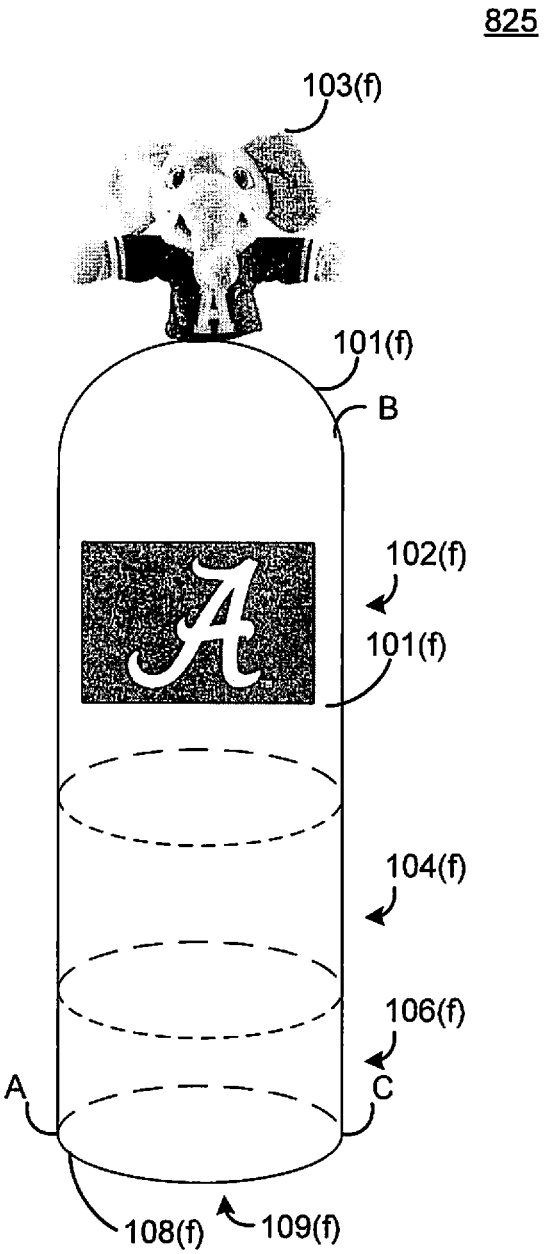
Figure 8D:
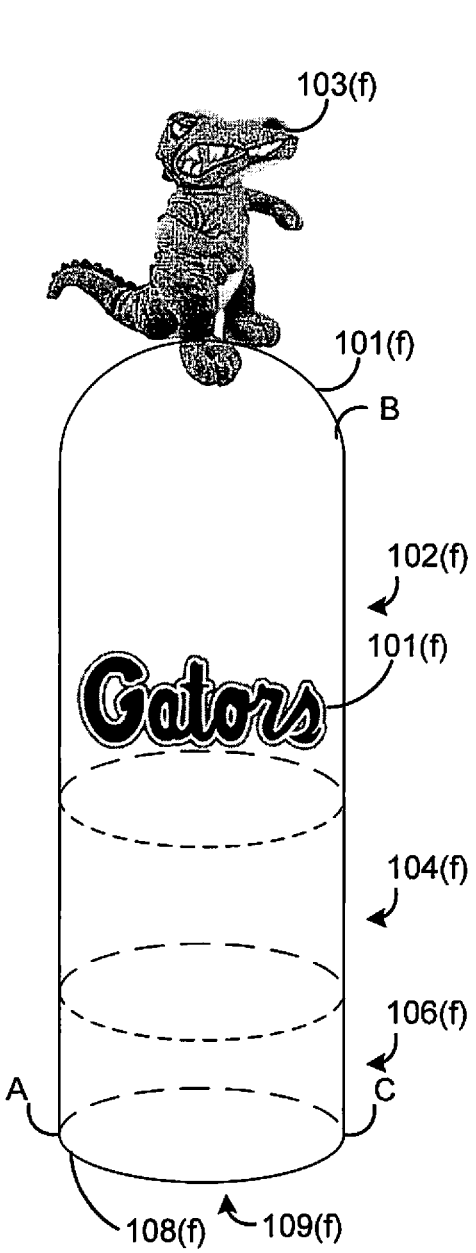

FIG. 8C depicts a University of Alabama Elephant mascot on top of a cover with a University of Alabama "A" in a message area. FIG. 8D depicts a University of Florida Gator mascot on top of a cover with a University of Florida "Gators" in a message area.

Figure 8E:
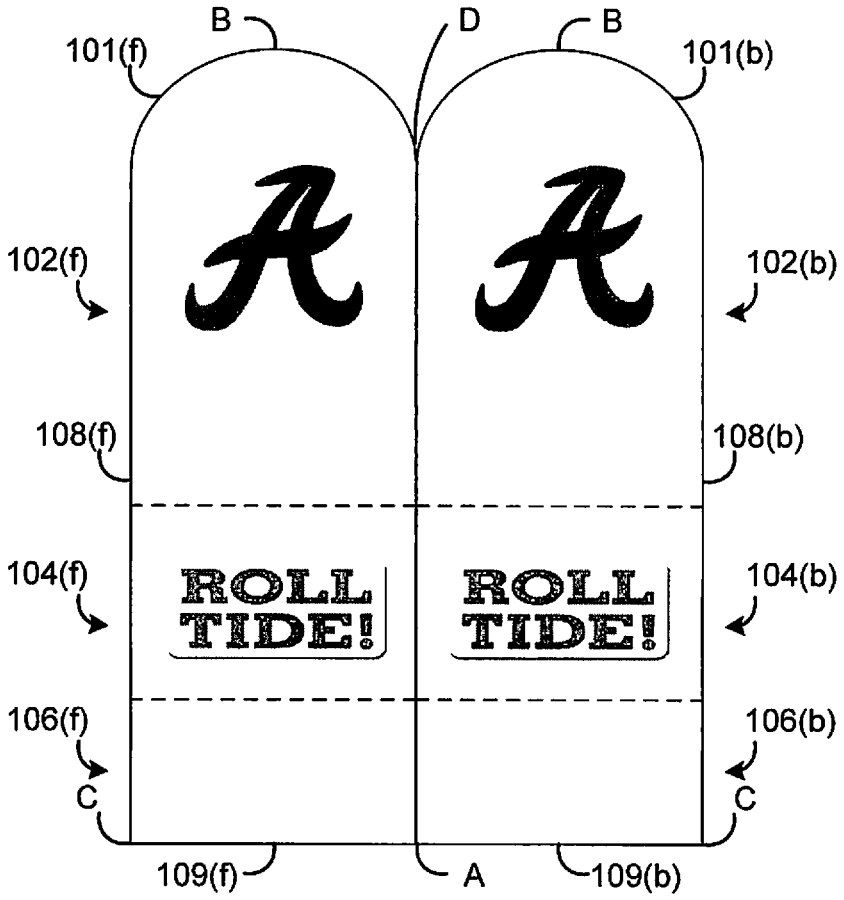
Figure 8F:
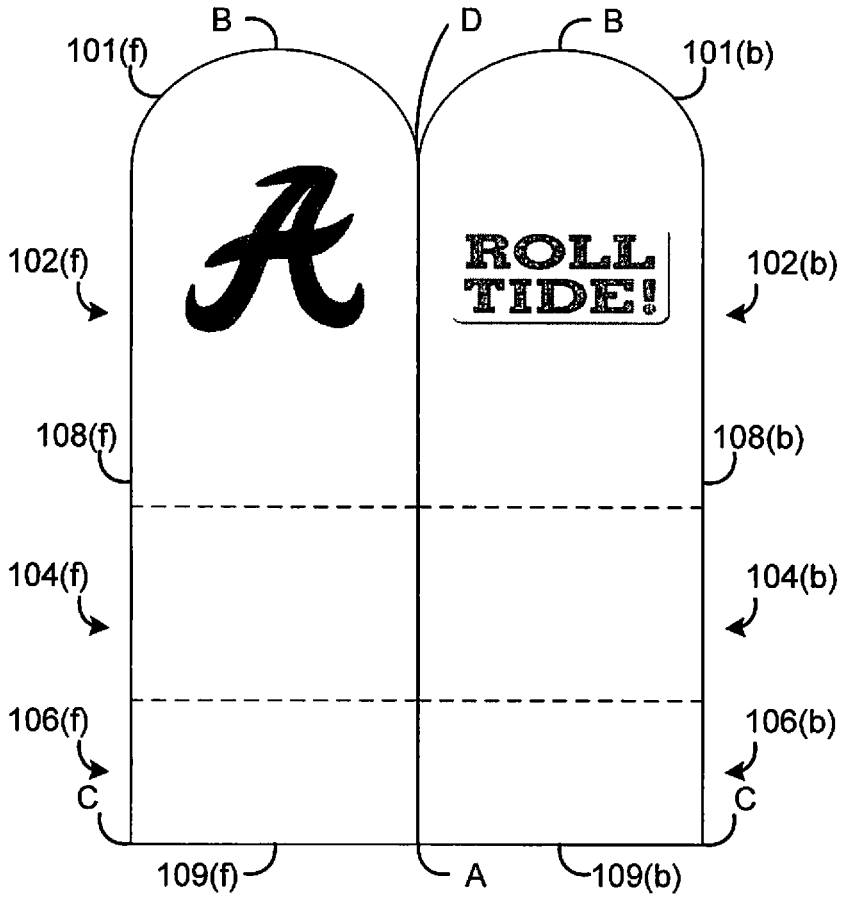
Figure 8G:
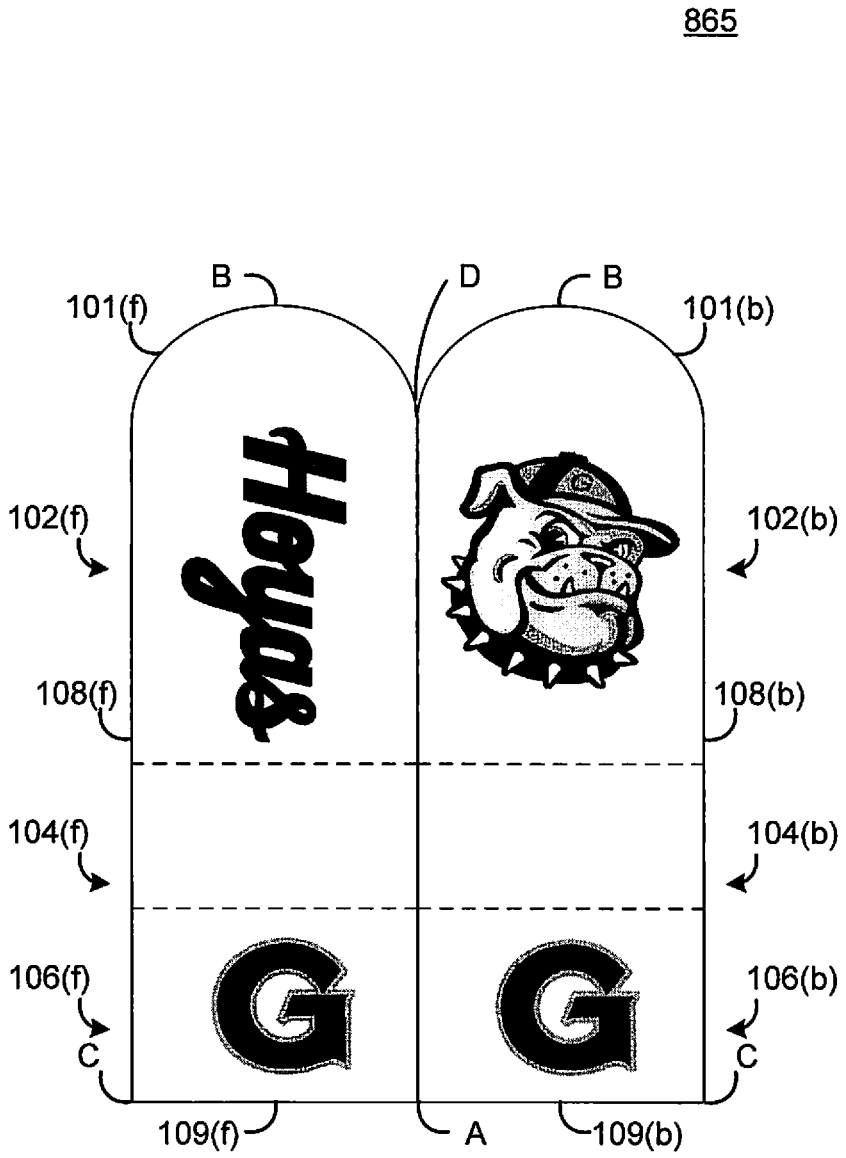

FIG. 8E depicts two sides of a digit cover where a message in a first message area of the first side is the same as a message in a first message area of a second side and a message in a third message area of the first side is the same as a message in a third message area of a second side. FIG. 8F depicts two sides of a digit cover where a message in a first message area of the first side is different from a message in a first message area of a second side. FIG. 8G depicts two sides of a digit cover where a message in a first message area of the first side is different from a message in a first message area of a second side and a message in a third message area of the first side is the same as a message in a third message area of a second side.

While the invention has been described and illustrated with reference to specific exemplary embodiments, it should be understood that many modifications, combinations, and substitutions can be made without departing from the spirit and scope of the invention. For example, although the invention is described above with respect to a covering for a single digit. However, the invention is not so limited and can apply to a plurality of digits or a portion thereof, a hand or a portion thereof, and an arm including the hand or a portion thereof. Additionally, although message areas are described in particular locations and having a set number of message areas and having particular shapes in the examples, the invention is not so limited—the invention can have multiple message areas in various locations in various shapes, or lack of shapes, on a digit cover. Accordingly, the invention is not to be considered as limited by the foregoing description but is only limited by the scope of the claims.

What is claimed as new and desired to be protected by Letters Patent of the United States is:

1. A method for making a finger cover for substantially covering a finger, comprising:

forming a first portion of said finger cover of a first material, said first portion having a first top and a first bottom and a first peripheral edge, wherein said first portion is one of a front side and a back side of said finger cover;

forming a first message in a first message area of said first portion;

forming a second portion of said finger cover of a second material, said second portion having a second top and a second bottom and a second peripheral edge, wherein said second portion is the other of said front side and a back side of said finger cover, and wherein said first and second peripheral edges are substantially similar in shape;

forming a second message in a second message area of said second portion;

substantially aligning said first and second portions of said finger cover such that said first and second tops are generally adjacent to one another, said first and second bottoms are generally adjacent one another, and said first and second peripheral edges are substantially aligned; and substantially fastening said first portion to said second portion along a mutually aligned region of said first and second peripheral edges, such that said respective bottoms of said first portion and said second portion form an aperture, said aperture adapted to receive a finger, wherein said first material is different from said second material.

2. The method of claim 1 wherein said first message is substantially the same as said second message.

3. The method of claim 1 wherein said first message is different from said second message.

4. The method of claim 1, further comprising:

forming said first portion of said finger cover and forming said second portion of said finger cover such that when said first portion and said second portion are fastened, the resulting finger cover being substantially tapered in shape, said tapered shape being smaller at a top of said finger cover and larger at a bottom of said finger cover.

5. The method of claim 1, further comprising:

forming said first portion of said finger cover and forming said second portion of said finger cover such that when said first portion and said second portion are fastened, the resulting finger cover is adapted to being substantially form-fitting to a finger.

6. The method of claim 1, further comprising:

forming a third message in a third message area of said first portion of said finger cover; and forming a fourth message in a fourth message area of said second portion of said finger cover;

wherein said first message and said third message are substantially the same.

7. The method of claim 1, further comprising:

forming a cover topping on a top end of said finger cover.

8. The method of claim 1, further comprising:

forming a closed end portion of said finger cover at a top of said finger cover; and hingeably fastening said close end portion to a lower aspect of said finger cover.

9. The method of claim 1, wherein said step of forming said first message further comprises:

defining a first substantially slanted vertical box shaped area within said first portion; and forming said first message substantially within said first shaped area.

10. The method of claim 1, wherein said first material comprises a substantially elastic material.

11. The method of claim 1, wherein said first material comprises a substantially elastic material having no less than substantially 80% polyester.

12. The method of claim 1, further comprises:

forming a touch screen area in said first portion from a material that reduces thermal loss.

13. The method of claim 1, further comprises:

forming substantially a band of a third material that reduces thermal loss in said first and second portions of said finger cover, wherein said band is adapted to coincide with a finger pad of said finger placed into said finger cover, said band having a top edge and a bottom edge, wherein said third material is different from said first material, wherein said third material is different from said second material, wherein a top edge of said band is separate from a top of said finger cover, wherein said first material is employed in said first portion between said top edge of said band and said top of said first portion.

14. A method for making a finger cover for substantially covering a finger, comprising:

forming a first portion of said finger cover of a first material, wherein said first portion having a top and a bottom, wherein said first material comprises a substantially elastic material;

forming a first message in a first message area of said first portion;

forming a second portion of said finger cover of a second material, wherein said second portion having a top and a bottom, said first portion of said first material being substantially similar in shape and design as said second portion of said second material;

forming a second message in a second message area of said second portion, wherein said first message is different from said second message;

substantially aligning a first portion of material with a second portion of material such that the aligned portions have said tops of said respectful portions being substantially aligned and said bottoms of said respectful portions being substantially aligned;

substantially aligning said first and second portions of said finger cover such that said first and second tops are generally adjacent to one another, said first and second bottoms are generally adjacent one another, and said first and second peripheral edges are substantially aligned;

substantially fastening said first portion to said second portion along a mutually aligned region of said first and second peripheral edges, such that said respective bottoms of said first portion and said second portion form an aperture, said aperture adapted to receive a finger;

wherein said finger cover being substantially tapered in shape, said tapered shape being smaller at a top of said finger cover and larger at a bottom of said finger cover;

wherein said finger cover is adapted to being substantially form-fitting to a finger;

forming a third message in a third message area of said first portion of aid finger cover;

forming a fourth message in a fourth message area of said second portion of said finger cover;

wherein said first message and said third message are substantially the same;

forming a cover topping on said top end of said finger cover;

forming a closed end portion of said finger cover;

hingeably fastening said close end portion to a lower aspect of said finger cover;

defining a substantially slanted vertical box shaped area within said first portion; and forming said first message substantially within said shaped area; and forming substantially a band of a third material that reduces thermal loss in said finger cover, said band having a top edge and a bottom edge, wherein said band is adapted to substantially coincide with a finger pad of said finger placed into said finger cover, wherein said third material is different from said first material, wherein said third material is different from said second material, wherein said top edge of said band is separate from a top of said finger cover, wherein said first material is employed in said first portion between said top edge of said band and said top of said first portion.

15. A finger cover for substantially covering a finger, comprising:

a first portion of a first material, wherein said first portion having a top and a bottom and having a first message in a first message area of said first portion; and a second portion of a second material, wherein said second portion having a top and a bottom, said first portion of said first material being substantially similar in shape and design as said second portion of said second material and having a second message in a second message area of said second portion;

wherein said first portion of material being substantially aligned with a second portion of material such that the aligned portions have said tops of said respectful portions being substantially aligned and said bottoms of said respectful portions being substantially aligned, wherein said first portion substantially fastening to said second portion substantially along the aligned edges of said first and second portions, thereby forming an aperture by said respective bottom edges of said first portion and said second portion, said aperture adapted to receive said finger, wherein said first material is different from said second material.

16. The finger cover of claim 15, wherein said first portion and said second portion are formed such that when said first portion and said second portion are fastened, the resulting fastened portions are substantially tapered in shape, said tapered shape being smaller at said top edge and larger at said bottom edge.

17. The finger cover of claim 16, wherein said first portion and said second portion are formed such that when said first portion and said second portion are fastened, the resulting fastened portions are substantially form-fitting to a finger.

18. The finger cover of claim 15, further comprising:

a cover topping on said top end of said fastened first and second portions.

19. The finger cover of claim 15, wherein a closed end portion of said fabric cover is hingeably fastened to a lower portion of said fabric cover.

20. The finger cover of claim 15, wherein said first material comprises a substantially elastic material.

* * * * *